US008382236B2

(12) United States Patent
Shimazaki

(10) Patent No.: US 8,382,236 B2
(45) Date of Patent: Feb. 26, 2013

(54) LIQUID EJECTION DEVICE

(75) Inventor: Jun Shimazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 247 days.

(21) Appl. No.: 13/023,004

(22) Filed: Feb. 8, 2011

(65) Prior Publication Data

US 2011/0199422 A1 Aug. 18, 2011

(30) Foreign Application Priority Data

Feb. 15, 2010 (JP) ..... 2010-029849

(51) Int. Cl.
*B41J 2/165* (2006.01)

(52) U.S. Cl. ..... 347/29; 347/25

(58) Field of Classification Search ..... 347/15, 347/29, 30, 33, 36
See application file for complete search history.

(56) References Cited

U.S. PATENT DOCUMENTS 6,481,826 B1 11/2002 Hara et al.
7,357,478 B2 * 4/2008 Usuda et al. ..... 347/29
7,625,080 B2 * 12/2009 Hess et al. ..... 347/92
7,735,957 B2 * 6/2010 Kudo et al. ..... 347/30

FOREIGN PATENT DOCUMENTS

JP 2001-146018 A 5/2001

* cited by examiner

*Primary Examiner* — Lamson Nguyen
(74) *Attorney, Agent, or Firm* — Global IP Counselors, LLP

(57) ABSTRACT

A liquid ejection device includes a liquid ejection head and a capping mechanism. The liquid ejection head includes nozzles for ejecting a liquid. The capping mechanism covers the nozzles and receiving the liquid, the capping mechanism being selectively disposed in a contacting state in which the capping mechanism contacts with a nozzle formation surface of the liquid ejection head or in a separated state in which the capping mechanism is separated from the nozzle formation surface. The capping mechanism includes a cap member forming a space in which openings of the nozzles are hermetically sealed in the contacting state, and a pressurizing unit configured to increase pressure in an inner space surrounded by the nozzle formation surface and an inner surface of the cap member.

7 Claims, 6 Drawing Sheets

LIQUID EJECTION DEVICE

CROSS-REFERENCE TO RELATED APPLICATIONS

This application claims priority to Japanese Patent Application No. 2010-029849 filed on Feb. 15, 2010. The entire disclosure of Japanese Patent Application No. 2010-029849 is hereby incorporated herein by reference.

BACKGROUND

1. Technical Field

The present invention relates to a liquid ejection device.

2. Related Art

An inkjet printer (hereinafter referred to as a "printer"), which is one type of liquid ejection device, performs printing by ejecting ink (liquid) onto a recording medium through nozzles formed in a nozzle formation surface of a recording head (liquid ejection head) incorporated in a carriage.

Because the water content of the ink tends to evaporate through openings of the nozzles, the viscosity of the ink in the nozzles increases and hence the nozzles are easily clogged. A printer is typically designed to prevent the nozzles from being clogged by performing a maintenance step (cleaning, flushing, or any other suitable step) of forcibly discharging ink in the nozzles on a regular basis.

Such a printer is further designed, when not in use, to inhibit evaporation of the water content of the ink through the openings of the nozzles by sealing the nozzle formation surface of the recording head with a cap (see Japanese Patent Laid-Open Publication No. 2001-146018, for example).

SUMMARY

The following problem may however occur when the sealing cap is removed and printing is initiated.

FIGS. 7A to 7C are schematic diagrams showing that a problem occurs in a printer having a structure of related art. As shown in FIG. 7A, when a cap member 140 used to seal the openings of a plurality of nozzles 302 provided in a recording head 300 is lowered and removed, a film of ink (ink film M) is formed in some cases between a nozzle formation surface 301 and an end of the cap member 140 due to the surface tension of an ink solvent.

The reason for this is that regular cleaning or flushing of the recording head 300 causes in some cases a certain amount of ink to adhere to the nozzle formation surface 301 and when the cap member 140 comes into intimate contact with the nozzle formation surface 301, the ink is sandwiched between the nozzle formation surface 301 and the cap member 140. Further, a surfactant is added to ink used with a liquid ejection device in some cases in order to prevent a flow path from being blocked and to improve the fluidity in the flow path. In this case, the action of the surfactant encourages the ink film M to expand.

As shown in FIG. 7B, when the cap member 140 is lowered, the volume of an inner space S1 surrounded by the nozzle formation surface 301, the cap member 140, and the ink film M increases. Because the inner space S1 has a negative pressure with respect to the atmosphere at this point, the ink film M is pressed by external pressure and the ink film M deforms inward and forms a concave shape relative to the inner space S1.

As shown in FIG. 7C, when the cap member 140 is lowered further, the ink film M breaks at some point and splatters into ink droplets D. At this point, because the ink film M is pressed by external pressure, the droplets D splatter toward the inner space S1. If the droplets D adhere to the nozzle formation surface 301 so that they block the openings of the nozzles 302 as indicated by the reference character X, the nozzles 302 to which the droplets D have adhered will cause a printing failure called dead dots. To prevent the printing failure, it is necessary to clean the nozzle formation surface 301 after the cap member 140 is removed, but this step increases the period from the time at which a printing start instruction is issued to the time at which actual printing starts and hence degrades the operability of the printer.

The invention has been made in view of the circumstances described above. An object of the invention is to provide a liquid ejection device that does not experience printing failure even when an ink film formed between a cap member and a recording head breaks and splatters into ink droplets, because the ink droplets do not adhere to nozzle openings.

To achieve the object described above, a liquid ejection device according to one aspect of the present invention includes a liquid ejection head and a capping mechanism. The liquid ejection head includes nozzles for ejecting a liquid. The capping mechanism covers the nozzles and receiving the liquid, the capping mechanism being selectively disposed in a contacting state in which the capping mechanism contacts with a nozzle formation surface of the liquid ejection head or in a separated state in which the capping mechanism is separated from the nozzle formation surface. The capping mechanism includes a cap member forming a space in which openings of the nozzles are hermetically sealed in the contacting state, and a pressurizing unit configured to increase pressure in an inner space surrounded by the nozzle formation surface and an inner surface of the cap member.

According to the configuration described above, when a film of liquid (ink film) is formed between the nozzle formation surface and an end of the cap member, the pressurizing unit increases the pressure in the inner space, and the ink film accordingly swells outward relative to the inner space. In this case, droplets created when the ink film breaks splatter outward relative to the inner space. Because the droplets will not therefore adhere to or cover the openings of the nozzles, the liquid ejection device will not experience printing failure.

In the liquid ejection device as described above, a variety of forms can be used as the pressurizing unit. For example, the pressurizing unit preferably includes a gas supply unit configured to supply a gas into the inner space.

According to this configuration, the intended purpose of pressurizing the inner space can be achieved by supplying a gas into the inner space to increase the amount of gas contained in the inner space.

In the liquid ejection device as described above, the cap member preferably has a discharge pipe through which the liquid ejected toward the inner surface of the cap member is discharged. The discharge pipe is preferably connected to a first pipe having one end communicating with the atmosphere and a second pipe having one end connected to the cap member. The first pipe is preferably disposed on an upstream side of the second pipe with respect to the discharge pipe. The first pipe, the second pipe, and a portion of the discharge pipe that is disposed between connection points where the first pipe and the second pipe are connected to the discharge pipe preferably form supply piping configured to supply the gas from the atmosphere into the inner space. A switching unit configured to selectively choose the discharge pipe or the supply piping is preferably provided at both the connection point where the first pipe is connected to the discharge pipe and the connection point where the second pipe is connected to the discharge pipe. A pump configured to force the liquid or the gas to flow downstream is preferably provided at a point along the portion of the discharge pipe that is disposed between the switching units.

According to this configuration, since a single pump can serve not only as a device that discharges the liquid but also as a device that supplies the gas, the configuration of the apparatus is simplified.

In the liquid ejection device as described above, the pressurizing unit preferably includes a heating unit configured to heat the cap member.

According to this configuration, the intended purpose of pressurizing the inner space can be achieved by heating the cap member to heat and expand a certain amount of the gas contained in the inner space.

In the liquid ejection device as described above, the pressurizing unit preferably includes a capacity-changing unit configured to reduce a capacity of the cap member.

According to this configuration, the intended purpose of pressurizing the inner space can be achieved by reducing the capacity of the inner space with respect to a certain amount of the gas contained in the inner space.

The liquid ejection device as described above preferably further includes a controller configured to control the pressuring unit of the capping mechanism to increase the pressure in the inner space in response to an action of the cap member separating from the nozzle formation surface.

According to this configuration, because the pressure in the inner space is increased immediately after the ink film is formed, the ink film deforms inward and forms a concave shape relative to the inner space, so that it becomes impossible for ink droplets to fly toward the inner space. Printing failure can therefore be prevented in a satisfactory manner.

In the liquid ejection device as described above the controller preferably instructs the pressurizing unit to increase the pressure in the inner space before the cap member is separated from the nozzle formation surface.

According to this configuration, because the pressure in the inner space has already been increased when the cap member is separated from the nozzle formation surface, the pressure in the inner space can be reliably increased without any time lag between the motion of the cap member and the increase in pressure in the inner space, and printing failure can be reliably inhibited.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

A liquid ejection device according to a first embodiment of the invention will be described below with reference to FIGS. 1 to 4. In all the following drawings, the dimensions and proportions of components differ as required for ease of illustration.

Figure 1:
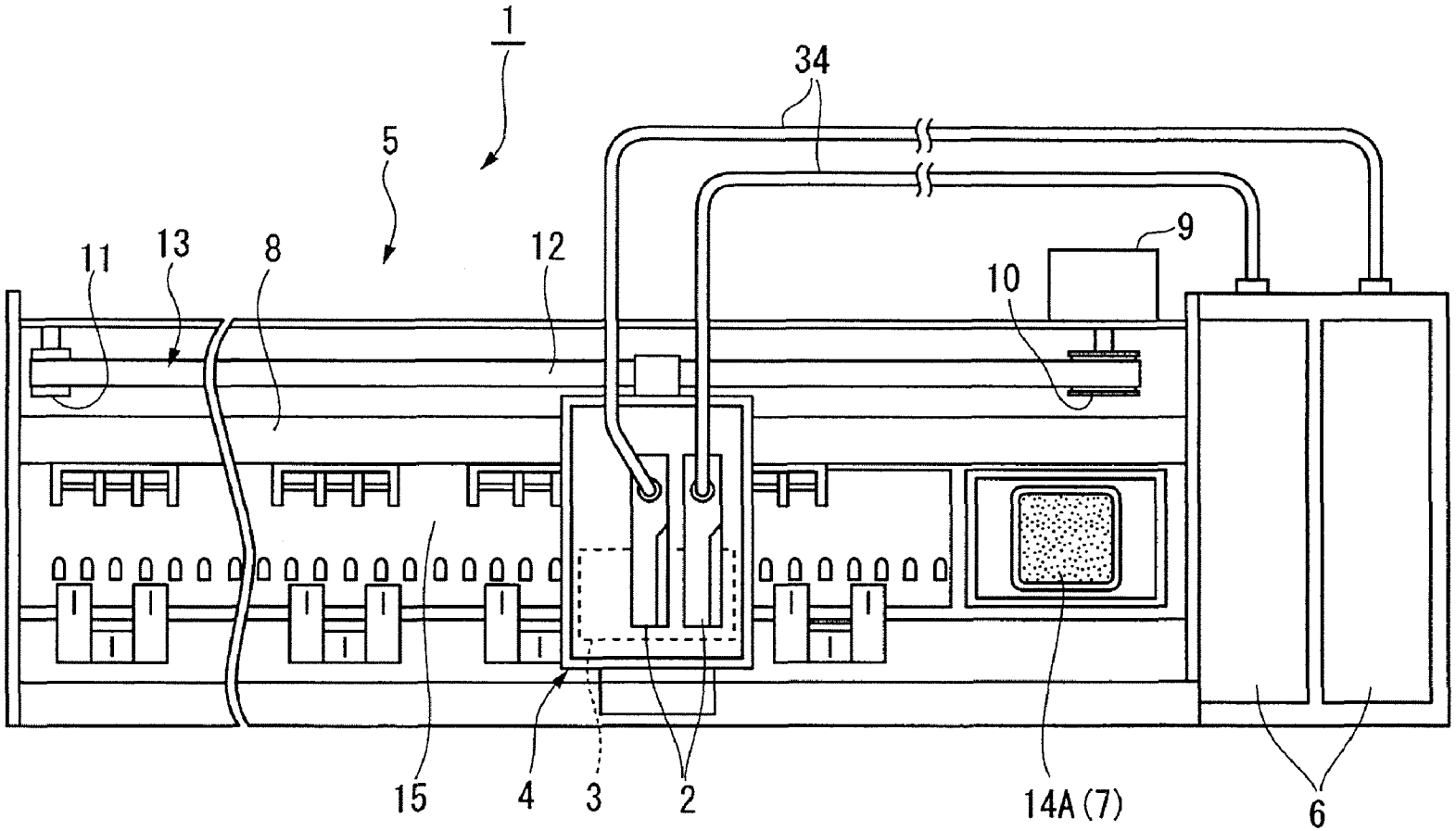
FIG. 1 is a partial view showing a schematic configuration of a printer according to an embodiment of the invention.

FIG. 1 is a partial view showing a schematic configuration of a printer (liquid ejection device) 1 according to the first embodiment of the invention. The printer 1 generally has a carriage 4 in which sub-tanks 2 and a recording head 3 are incorporated, and a printer body 5. The printer body 5 is provided with a carriage translation mechanism 13 that translates the carriage 4 in reciprocating motion, a sheet feed mechanism that transports a recording sheet (not shown), a capping mechanism 14A used to clean or otherwise treat the recording head (liquid ejection head) 3, and ink cartridges 6 that store ink supplied to the recording head 3 through supply tubes 34.

The capping mechanism 14A includes an ink droplet sensor 7 capable of detecting an ink droplet discharged from the recording head 3. The ink droplet sensor 7 can sense how well ink is ejected through the nozzles, by charging ink droplets discharged through the nozzles in the recording head 3 and outputting a detection signal representing the change in voltage based on electrostatic induction that occurs when the charged ink droplets fly.

The carriage translation mechanism 13 includes a guide shaft 8 extending in the width direction of the printer body 5, a pulse motor 9, a drive pulley 10 connected to a rotating shaft of the pulse motor 9 and rotated by the pulse motor 9, a driven pulley 11 provided on the opposite side to the drive pulley 10 in the width direction of the printer body 5, and a timing belt 12 extending between the drive pulley 10 and the driven pulley 11 and connected to the carriage 4.

The carriage 4 is configured to make reciprocating motion in a primary scan direction along the guide shaft 8 when the pulse motor 9 is driven. The sheet feed mechanism includes a sheet feed motor (not shown) and a sheet feed roller (not shown) rotated by the sheet feed motor and successively feeds recording sheets onto a platen 15 in synchronization with the recording (character and graphic printing) action.

Figure 2A:
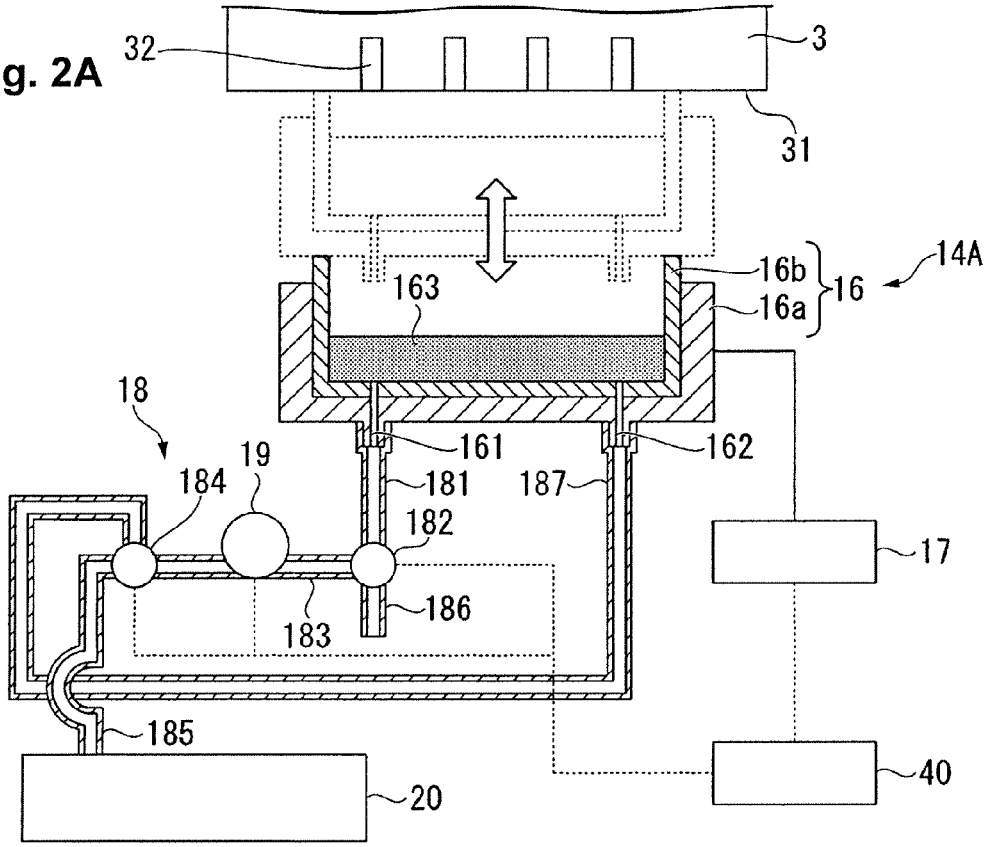
FIG. 2 are descriptive diagrams of a capping mechanism provided in the printer according to a first embodiment.
Figure 2B:
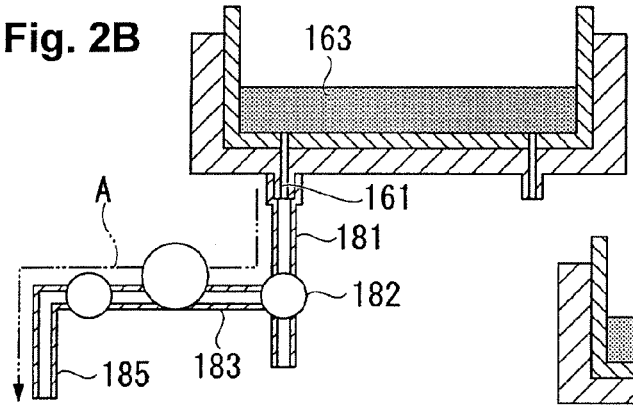
Figure 2C:
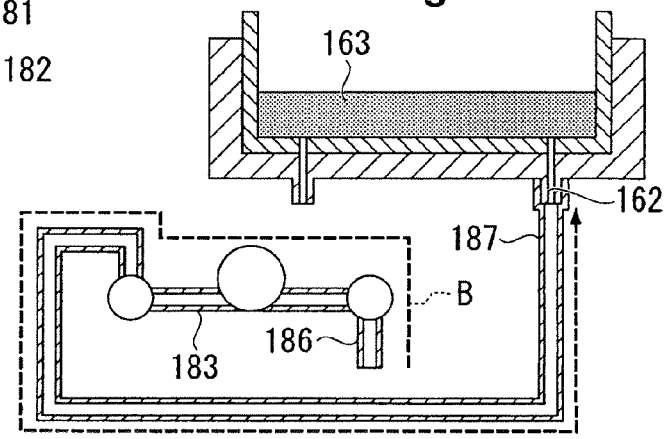

FIGS. 2A to 2C are descriptive diagrams showing the capping mechanism 14A in the present embodiment. FIG. 2A is a schematic view showing an overall configuration of the capping mechanism 14A. FIGS. 2B and 2C are descriptive views for describing two possible paths for choosing the piping included in the capping mechanism 14A.

As shown in FIG. 2A, the capping mechanism 14A has a cap (cap member) 16 that covers the openings of nozzles 32, a lifting device 17 that moves the cap 16 upward and downward, piping 18 connected to the bottom of the cap 16, a pump (gas supply unit, pressurizing unit) 19 connected to a point somewhere along the path of the piping 18, and a waste liquid tank 20 that stores waste ink ejected through the nozzles 32 into the cap 16.

The cap 16 includes a cap holder 16*a* and a cap member 16*b*. The cap holder 16*a* has a box-like shape with an upper opening facing a nozzle formation surface 31 of the recording head 3. The cap member 16*b* is made of elastomer or any other flexible material and supported by the inner wall of the cap holder 16*a*. The upper edge of the cap member 16*b* protrudes upward beyond the upper edge of the cap holder 16*a*.

The cap 16 is attached movably upward and downward when driven by a drive motor provided in the lifting device 17 and can make reciprocating motions between a capping position (contacting state) where the cap member 16*b* comes into contact with the nozzle formation surface 31 and seals the openings of the nozzles 32, as indicated by the broken lines in FIG. 2A, and a retracted position (separated state) where the cap member 16*b* is separated from the recording head 3, as indicated by the solid lines in FIG. 2A.

An ink absorber 163 having a sheet-like shape and made of sponge or any other similar material is accommodated in the cap member 16*b* on the bottom surface thereof The ink absorber 163 receives and absorbs ink discharged from the recording head 3. When the cap 16 seals the nozzle formation surface 31, the solvent of the absorbed ink volatilizes into a space formed by the nozzle formation surface 31 and the cap 16 (hereinafter referred to as an inner space S1), and prevents the openings of the nozzles 32 from drying out.

Further, an ink discharge port 161 and an air supply port 162 are formed through the bottom of the cap 16 and connected to the piping 18.

The piping 18 has three-way valves (switching unit) 182 and 184 disposed at some points along the path thereof, and switching the three-way valves allows either a flow path A shown in FIG. 2B or a flow path B shown in FIG. 2C to be selectively switched.

The flow path A shown in FIG. 2B allows waste ink discharged into the cap 16 to flow into the waste liquid tank 20. The flow path A includes a pipe 181 that connects the ink discharge port 161 to the three-way valve 182, a pipe 183 that connects the three-way valve 182 to the three-way valve 184, and a pipe 185 that connects the three-way valve 184 to the waste liquid tank 20. The pipes 181, 183, and 185 form a discharge pipe in this embodiment.

On the other hand, the flow path B shown in FIG. 2C not only allows air to be taken in through an atmosphere connection pipe (first pipe) 186 having one end that communicates with the atmosphere, but can also be used to deliver the intake air into the cap 16. The flow path B includes the atmosphere connection pipe 186 connected to the three-way valve 182, the pipe 183, and a pipe (second pipe) 187 that connects the three-way valve 184 to the air supply port 162. The atmosphere connection pipe 186, the pipe 183, and the pipe 187 form supply piping in this embodiment.

The atmosphere connection pipe 186 may be provided with a check valve. In this case, the check valve allows air to be externally supplied only in a forward direction toward the three-way valve 182 but automatically blocks air flowing through the three-way valve 182 toward the atmosphere.

The pump 19 is connected to a point somewhere along the path of the pipe 183. The pump 19 can be a typically known tube pump. The pump 19 not only performs head cleaning in which ink in the nozzles 32 and the like is suctioned, but also supplies air into the cap 16.

Head cleaning is performed, for example, when a printer that has not performed printing for a long time performs printing again. Alternatively, air is supplied into the cap 16 when printing is performed after head cleaning, specifically, when the cap 16 is removed from the recording head 3 (nozzle formation surface 31). These actions are performed based on instructions from a controller 40 that controls the capping mechanism 14A.

Figure 3A:
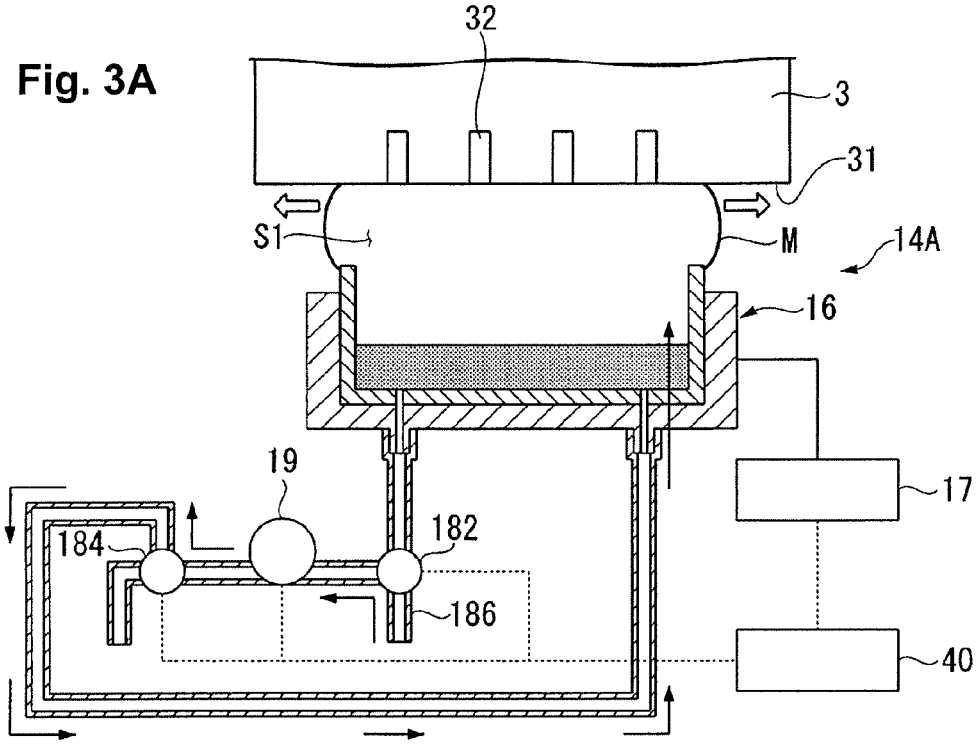
FIG. 3 are descriptive diagrams for describing the action of the capping mechanism in the first embodiment.
Figure 3B:
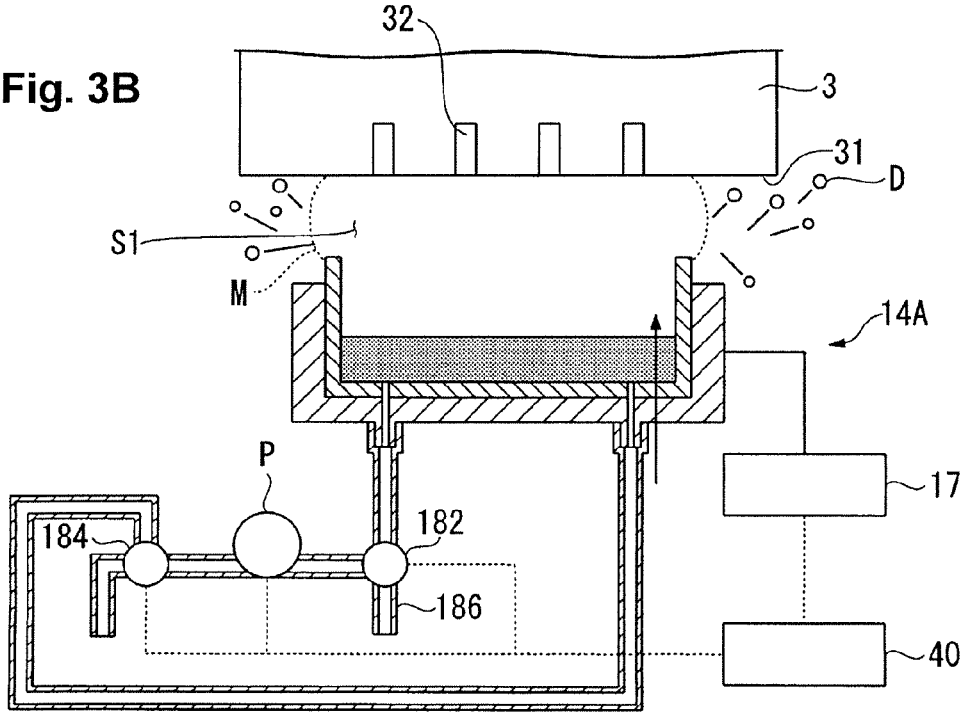

FIGS. 3A and 3B are descriptive views for describing the action of the printer 1 having the capping mechanism 14A described above.

As shown in FIG. 3A, when the lifting device 17 that has received an instruction from the controller 40 starts lowering the cap 16 that seals the openings of the nozzles 32, the controller 40 issues an instruction to the three-way valves 182 and 184 to switch the flow path of the piping 18 to the flow path B. The controller 40 further activates the pump 19 to suck air through the atmosphere connection pipe 186 and supplies the air into the cap 16.

As a result, because the supplied air increases the pressure in the inner space S1, an ink film M formed between the cap 16 and the nozzle formation surface 31 swells outward relative to the inner space S1. It should be noted here that when printing is performed, the pressure is increased to a level such that a meniscus of ink formed in each of the nozzles 32 does not break.

When air is continually supplied, the ink film M breaks at a point when it cannot withstand the internal pressure in the inner space S1, as shown in FIG. 3B. At this point, because the pressure in the inner space S1 has been increased, droplets D created when the ink film M breaks splatter outward relative to the inner space S1, which prevents the droplets D from adhering to and covering the openings of the nozzles 32.

The printer 1 of the present embodiment is configured as described above.

If the printer 1 is configured in the manner described above, high quality printing that prevents printing failure can be performed, because the droplets will not adhere to or cover the openings of the nozzles 32.

Further, in the present embodiment, the flow path A or B can be chosen for the piping 18 by switching the three-way valves 182 and 184 and the flow paths A and B share a common portion of the piping 18, but the invention is not limited to this configuration.

Figure 4:
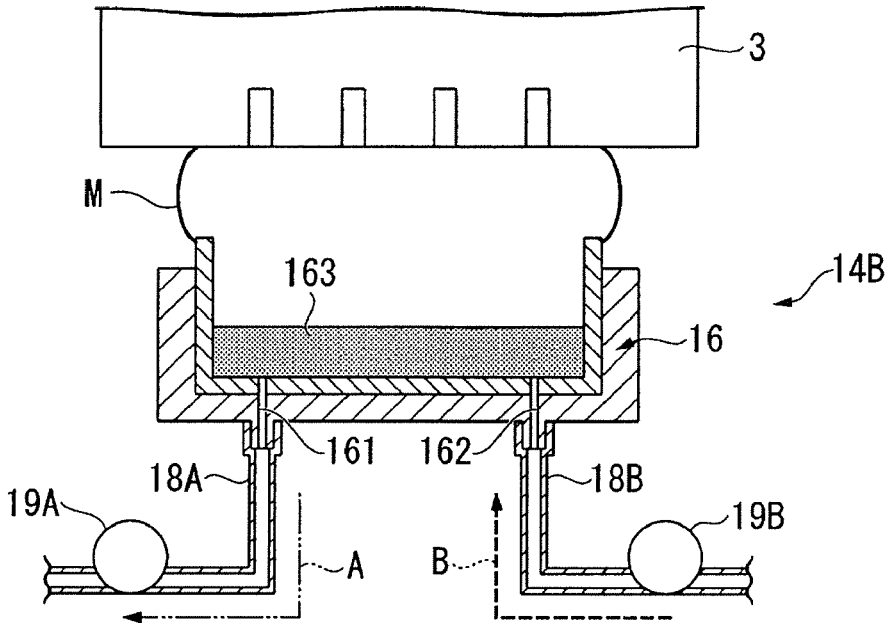
FIG. 4 is a descriptive diagram of a capping mechanism in a variation.

For example, a capping mechanism 14B shown in FIG. 4 can be employed as a variation in which a pipe 18A (flow path A) for discharging ink discharged into the cap 16 and a pipe 18B (flow path B) for delivering air into the cap 16 may be separately provided, and the pipes may be provided with respective pumps 19A and 19B.

Further, the controller 40 starts increasing the pressure in the inner space S1 after the cap starts lowering in the present embodiment. Alternatively, the controller 40 may start increasing the pressure in the inner space S1 before the cap 16 starts lowering. Because the pressure in the inner space S1 has thus already been increased when the cap 16 separates from the nozzle formation surface 31, the pressure in the inner space S1 can be reliably increased without any time lag between the motion of the cap 16 and the increase in pressure in the inner space S1, and printing failure can be reliably inhibited.

Second Embodiment

Figure 5:
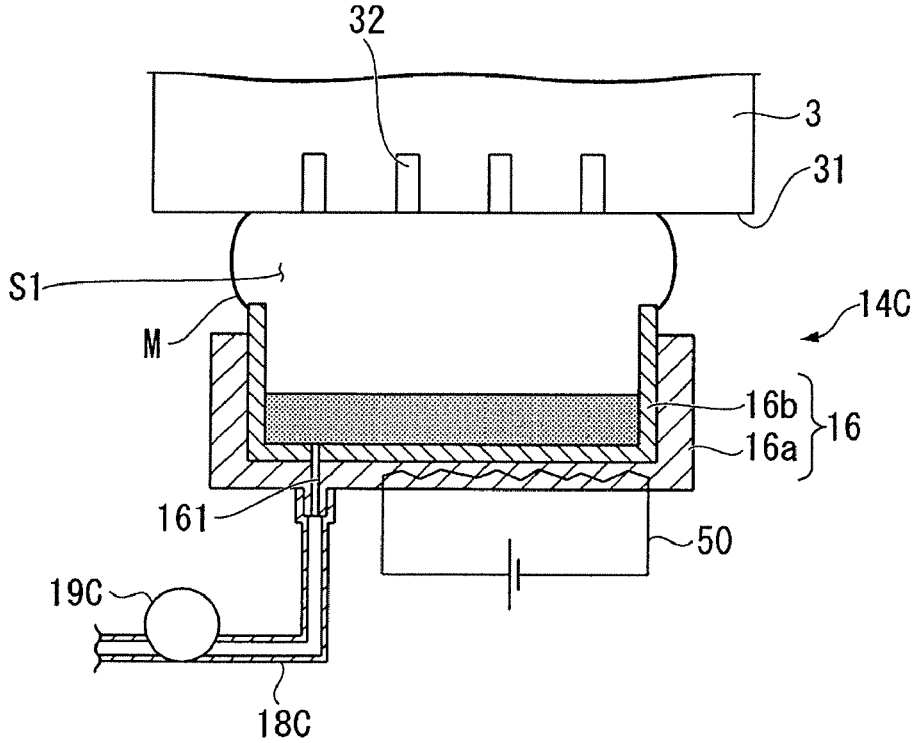
FIG. 5 is a descriptive diagram of a capping mechanism provided in a printer according to a second embodiment.

FIG. 5 is a descriptive diagram of a capping mechanism 14C provided in a printer according to a second embodiment of the invention. The capping mechanism 14C provided in the printer of the present embodiment is partly the same as the capping mechanism 14A provided in the printer of the first embodiment. They differ from each other in that the capping mechanism 14A increases the pressure in the inner space S1 by delivering air into the cap 16, whereas the capping mechanism 14C increases the pressure in the inner space S1 by heating gas in the inner space S1 to expand the gas. The components in the present embodiment that are common to those in the first embodiment have the identical reference numerals, and no description of these components will be made in detail.

As shown in FIG. 5, the capping mechanism 14C includes a pipe 18C which is connected to the ink discharge port 161 provided through the bottom of the cap 16 and through which waste ink flows into a waste liquid tank (not shown), and the pipe 18C is provided with a pump 19C. Further, the cap holder 16*a* is provided with a heater (heating unit, pressurizing unit) 50.

The heater 50, whose activation is controlled by a controller (not shown), heats the cap 16, before the cap 16 starts lowering and seals the nozzles 32, to indirectly heat the gas (a mixture of air and ink solvent) in the inner space S1 surrounded by the cap 16 and the nozzle formation surface 31.

The gas in the inner space S1, which is heated and expanded, increases the pressure in the inner space S1. As a result, the ink film M formed between the cap 16 and the nozzle formation surface 31 swells outward relative to the inner space S1, and the problem of droplets created when the ink film M breaks covering the openings of the nozzles 32 can be inhibited.

If the printer having a capping mechanism 14C is configured in the manner described above, high quality printing that prevents printing failure can also be performed.

Third Embodiment

Figure 6A:
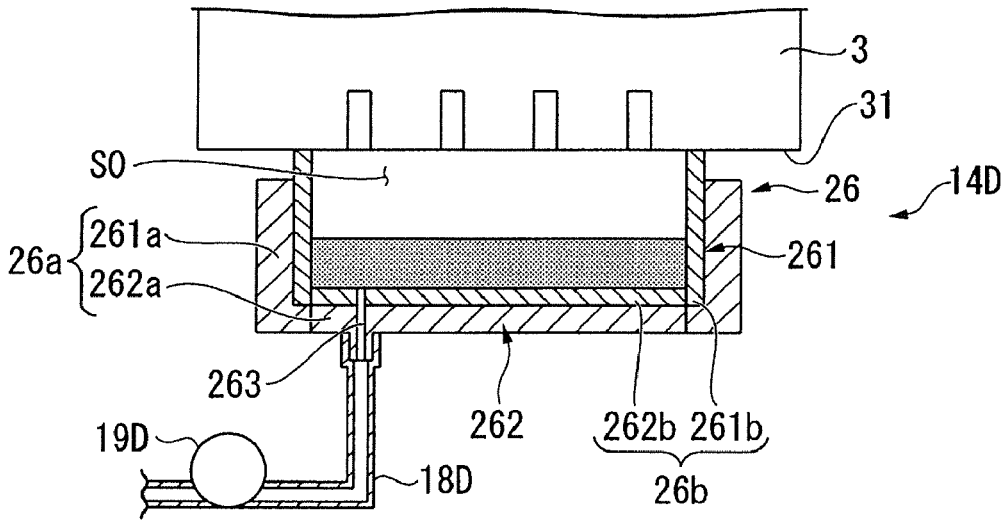
FIG. 6 are descriptive diagrams of a capping mechanism provided in a printer according to a third embodiment.
Figure 6B:
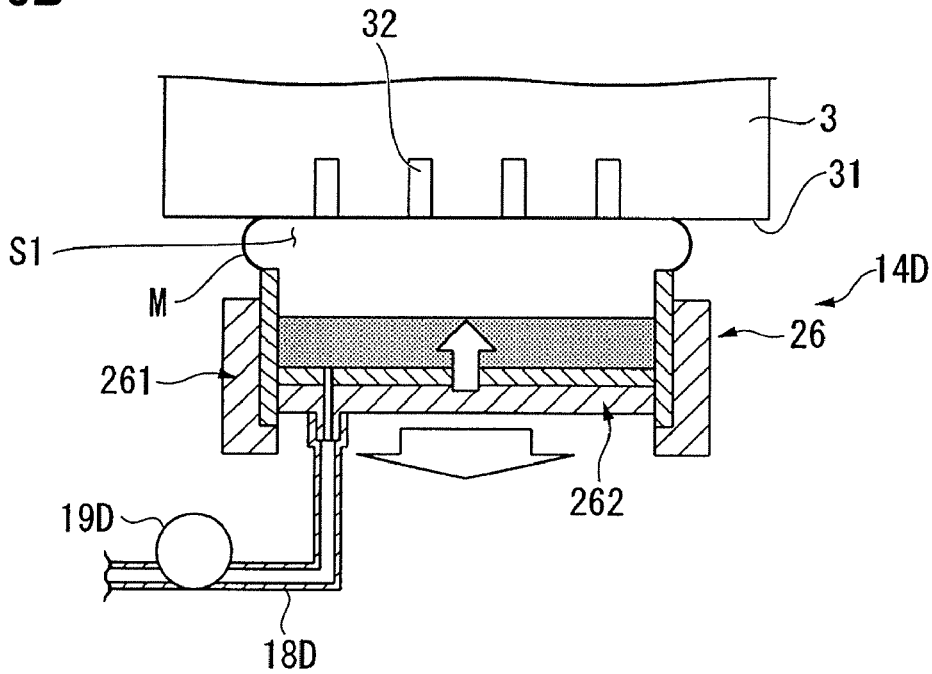
Figure 7A:
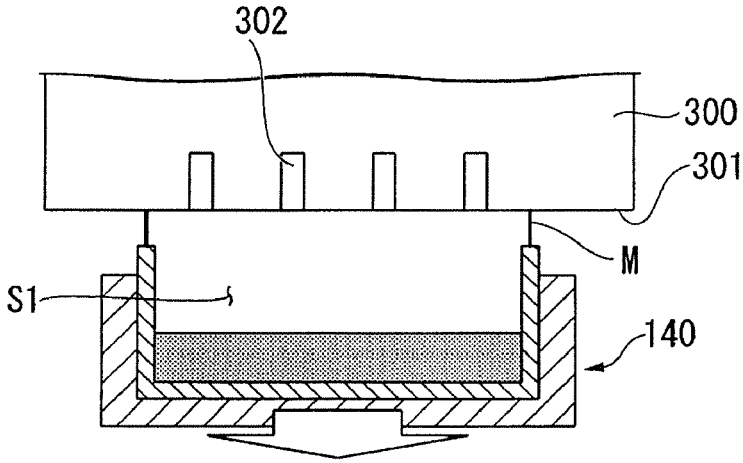
FIG. 7 are schematic views showing that a problem occurs in a printer having a structure of related art.
Figure 7B:
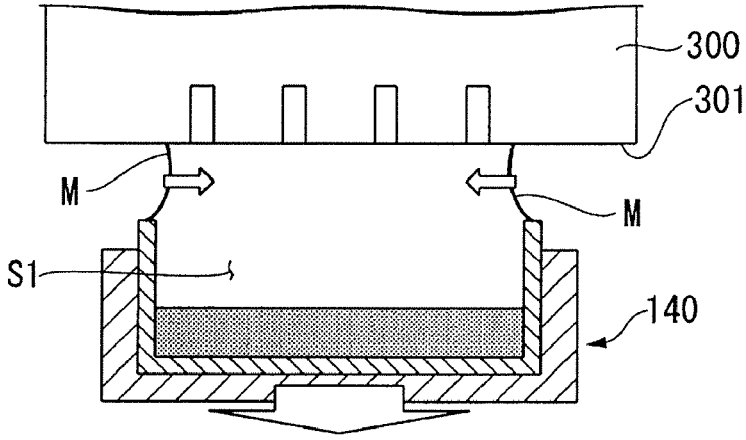
Figure 7C:
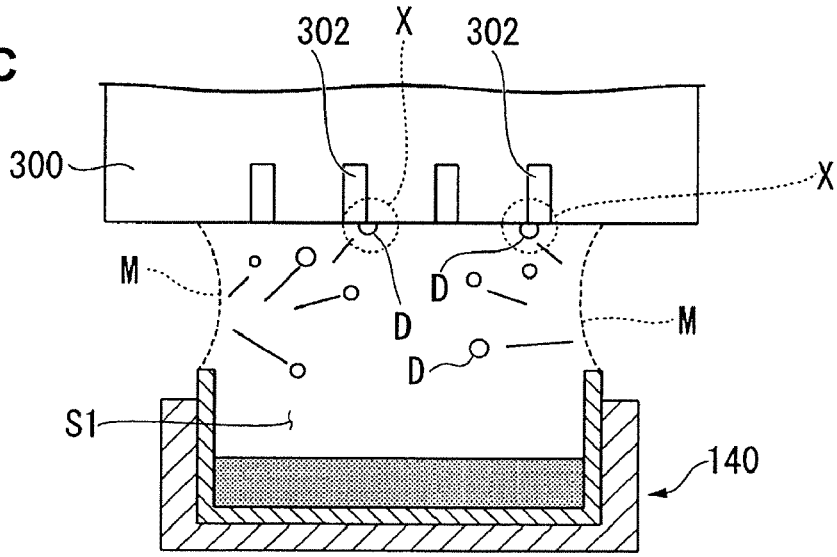

FIGS. 6A and 6B are descriptive diagrams of a capping mechanism 14D provided in a printer according to a third embodiment of the invention. The capping mechanism 14D provided in the printer of the present embodiment is partly the same as the capping mechanism 14A provided in the printer of the first embodiment. In the capping mechanism 14D, the capacity of the cap can be changed in order to change the volume of the inner space S1, thereby increasing the pressure in the inner space S1.

As shown in FIGS. 6A and 6B, a cap 26 provided in the capping mechanism 14D has a tubular cap side portion 261 that forms the side surface of the cap 26 and a cap bottom portion (capacity-changing unit, pressurizing unit) 262 that forms the bottom of the cap 26, and the cap bottom portion 262 fits into the cap side portion 261. A drive mechanism (not shown) can move the cap bottom portion 262 upward and downward inside the cap side portion 261.

The cap side portion 261 includes a cap holder 261*a* and a cap member 261*b*, and the cap bottom portion 262 includes a cap holder 262*a* and a cap member 262*b*. The cap holders 261*a* and 262*a* form a cap holder 26*a*, and the cap members 261*b* and 262*b* form a cap member 26*b*.

Further, a pipe 18D through which waste ink flows into a waste liquid tank (not shown) is connected to an ink discharge port 263 provided through the cap bottom portion 262, and the pipe 18D is provided with a pump 19D.

In the capping mechanism 14D configured in this manner, a contacting state in which the cap 26 is in intimate contact with the nozzle formation surface 31 as shown in FIG. 6A is called a reference state, and a controller holds reference data on the volume of a space (inner space) S0 in the reference state. When the cap 26 is lowered as shown in FIG. 6B, the controller increases the pressure in the inner space S1 by lifting the cap bottom portion 262 to make the volume of the inner space S1 smaller than the volume of the inner space S0 in the reference state.

The ink film M therefore swells outward relative to the inner space S1, and the problem of droplets created when the ink film M breaks covering the openings of the nozzles 32 can be inhibited.

If the printer having a capping mechanism 14D is configured in the manner described above, high quality printing that prevents printing failure can also be performed.

In the present embodiment, the capacity of the cap 26 is reduced by moving the cap bottom portion 262 so that the volume of the inner space S1 is changed. The invention is not limited to this configuration, but can employ any configuration that allows the capacity of the cap to be changed.

Preferred embodiments according to the invention have been described above with reference to the accompanying drawings, but the invention is, of course, not limited to the embodiments. The shapes of the components, combinations thereof, and other parameters described in the above embodiments have been presented by way of example, and a variety of changes can be made based on design and other requirements to the extent that the changes do not depart from the substance of the invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a liquid ejection head including nozzles for ejecting a liquid; and a capping mechanism covering the nozzles and receiving the liquid, the capping mechanism being selectively disposed in a contacting state in which the capping mechanism contacts with a nozzle formation surface of the liquid ejection head or in a separated state in which the capping mechanism is separated from the nozzle formation surface, the capping mechanism including a cap member forming a space in which openings of the nozzles are hermetically sealed in the contacting state, and a pressurizing unit configured to increase pressure in an inner space surrounded by the nozzle formation surface and an inner surface of the cap member.

2. The liquid ejection device according to claim 1, wherein the pressurizing unit includes a gas supply unit configured to supply a gas into the inner space.

3. The liquid ejection device according to claim 2, wherein the cap member has a discharge pipe through which the liquid ejected toward the inner surface of the cap member is discharged, the discharge pipe is connected to a first pipe having one end communicating with the atmosphere and a second pipe having one end connected to the cap member, the first pipe being disposed on an upstream side of the second pipe with respect to the discharge pipe, the first pipe, the second pipe, and a portion of the discharge pipe that is disposed between connection points where the first pipe and the second pipe are connected to the discharge pipe form supply piping configured to supply the gas from the atmosphere into the inner space, a switching unit configured to selectively choose the discharge pipe or the supply piping is provided at both the connection point where the first pipe is connected to the discharge pipe and the connection point where the second pipe is connected to the discharge pipe, and a pump configured to force the liquid or the gas to flow downstream is provided at a point along the portion of the discharge pipe that is disposed between the switching units.

4. The liquid ejection device according to claim 1, wherein the pressurizing unit includes a heating unit configured to heat the cap member.

5. The liquid ejection device according to claim 1, wherein the pressurizing unit includes a capacity-changing unit configured to reduce a capacity of the cap member.

6. The liquid ejection device according to claim 1, further comprising a controller configured to control the pressuring unit of the capping mechanism to increase the pressure in the inner space in response to an action of the cap member separating from the nozzle formation surface.

7. The liquid ejection device according to claim 6, wherein the controller instructs the pressurizing unit to increase the pressure in the inner space before the cap member is separated from the nozzle formation surface.

* * * * *